United States Patent [19]

Waldman

[11] Patent Number: 4,545,478

[45] Date of Patent: Oct. 8, 1985

[54] HARD CONTACT LENS SUCTION CUPS AND METHOD FOR THEIR PRODUCTION

[76] Inventor: Fred Waldman, 8929 E. Jewel Cir., Denver, Colo. 80231

[21] Appl. No.: 584,558

[22] Filed: Feb. 29, 1984

Related U.S. Application Data

[63] Continuation-in-part of Ser. No. 396,233, Jul. 8, 1982, abandoned.

[51] Int. Cl.[4] ..... B65D 85/00

[52] U.S. Cl. ..... 206/5.1; 294/1.2

[58] Field of Search ..... 206/501; 294/1 CA, 6 A

[56] References Cited

U.S. PATENT DOCUMENTS

| | | | |
|---|---|---|---|
| 3,052,246 | 9/1962 | Beard | 206/5.1 |
| 3,343,657 | 9/1967 | Speshyock | 206/5.1 |
| 3,367,481 | 2/1968 | Tanaka | 206/5.1 |
| 3,378,020 | 4/1968 | Grabiel | 206/5.1 |
| 3,524,455 | 8/1970 | Hoogesteger et al. | 206/5.1 |
| 3,770,113 | 11/1973 | Thomas | 206/5.1 |
| 3,990,579 | 11/1976 | Manning | 206/5.1 |
| 3,997,049 | 12/1976 | Sherman | 206/5.1 |
| 4,009,777 | 3/1971 | Thomas | 206/5.1 |
| 4,167,283 | 9/1979 | Feldman | 294/1.2 |
| 4,244,466 | 1/1981 | Arnhem | 206/5.1 |
| 4,332,318 | 6/1982 | Feldman | 206/5.1 |

FOREIGN PATENT DOCUMENTS

| | | | |
|---|---|---|---|
| 2301538 | 7/1974 | Fed. Rep. of Germany | 294/1.2 |
| 1197161 | 3/1969 | United Kingdom | 45/11 |

*Primary Examiner*—Joseph Man-Fu Moy

*Attorney, Agent, or Firm*—Jack C. Sloan

[57] ABSTRACT

Suction cups for storing hard or semi-rigid, gas permeable contact lenses in soaking solutions are provided with rims characterized by substantially horizontal ledges which are at least as wide as the sides of the suction cup are thick. The suction cups are made by injecting a plastic forming material into a stemmed suction cup mold and contacting the plastic forming material against the adjacent convex head and ledge of a cylindrical molding pin whose cylindrical body diameter is greater than the diameter of the base of its convex head. A ledge is thus formed between the base of the convex head and the outside surface of the cylindrical body so that the resulting suction cup has a substantially horizontal ledge as its upper rim.

4 Claims, 6 Drawing Figures

HARD CONTACT LENS SUCTION CUPS AND METHOD FOR THEIR PRODUCTION

CROSS REFERENCE TO THE RELATED APPLICATIONS

This application is a continuation-in-part of my previous patent application, Ser. No. 396,233, filed July 8, 1982, now abandoned.

BACKGROUND OF THE INVENTION

1. Field of the Invention

This invention relates generally to hard contact lens storage cases, and more particularly to hard contact lens storage cases having suction cups for holding so called hard contact lenses while they are suspended in soaking solutions contained in the storage cases.

2. Description of the Prior Art

Storage cases having suction cups for holding hard contact lenses while they are suspended in soaking solutions are well known. Representative patents disclosing such suction cups would include U.S. Pat. No. 4,167,283; British Pat. No. 1,197,161 and West German Pat. No. 2,301,538. As seen in FIG. 6 of U.S. Pat. No. 4,332,318 suction cups of this type are very often attached to stems which are in turn attached to the underside of the cap of the vial which contains the soaking solution. These patent drawings often depict their suction cups as having distinct rims which are as wide as the walls of the suction cups are thick. See for example FIG. 2 of U.S. Pat. No. 4,167,283 and FIG. 6 of U.S. Pat. No. 4,332,318. However, these depictions are more the result of the patent draftman's attempts to show the body of the suction cup and their associated stems than the physical reality of these suction cups when they are closely observed. In point of fact, the rims of these suction cups are not as wide as the thickness of the sides of the suction cups; they are much more narrow because of the way in which they are manufactured. These cups are produced by the cooperative action of two molds. The first mold has a hollow core which is shaped like a stem with a pod at one end. The pod forms the body of the suction cup. The concave upper surface of the suction cup is formed by the second mold. This second mold is a cylindrical molding pin having a convex head on one end which protrudes into the pod of the first mold. The cylindrical molding pin is inserted into a round molding chamber much like the way a bullet is inserted into the firing chamber of a rifle. The cylindrical molding pin is analogous to the shell case and the convex head is analogous to the bullet's head. In the case of the prior art molding pins, however, there are no discontinuities where the convex head and the cylindrical body come together. In other words, the diameter of the prior art convex head at its base is equal to the diameter of the cylindrical body of the molding pin. The equality of these two dimensions is important for reasons which can now be elaborated upon in terms of the methods by which the suction cups are produced. We should first not that the convex head of the second mold is inserted into the pod of the first mold so that only a thin gap exists between the concave pod and the convex head which protrudes into the pod. The plastic forming material is injected into the first mold up to and including the gap between the pod forming first mold and the convex head of the second mold. The material from which the suction cup is made is then plasticized. These materials are often referred to in this art as "elastomers" and a common example is known by the trade name Kraton. In any event the setting up of these materials results in the formation of a concave suction cup which, then, along with its associated stem, is withdrawn from the mold. The rims of the suction cups formed by this method, when viewed in a cross sectional view, appear as a point or at best a very narrow ledge depending on the degree of magnification. To the naked eye, a ledge is not discernible at the rim of the suction cup. Rather a cross section of the rim of the suction cup appears to come to a point. Furthermore, when viewed from the side under about 10 to 1 magnification these prior art rims do not appear as a straight line but rather as a very jagged edge. This jagged edge results when the plasticized material forming the pinched in rim edge is withdrawn from contact with the second mold. Since the pinched rim has relatively little body compared to the sides of the suction cup, the edge tends to tear as the suction cup is withdrawn from such molds. Unfortunately, these jagged edges permit air leaks between the suction cups and the hard contact lenses they are supposed to hold. Typically, suction cups made with such molds will not hold their suction for more than a few hours. Hence, the user often finds his hard contact lenses at the bottom of the storage vial for the soaking solution. Any number of different courses of action for retrieving the lenses from the bottom of the case are tedious, time consuming, injurious to the lenses and usually serve to contaminate the soaking solution. Therefore, suction cups with the ability to hold hard or semi-rigid, gas permeable contact lenses in place for periods of from 8 to 12 hours, e.g., overnight, would eliminate many of the above noted bad consequences which result from loss of the suction force between the hard contact lenses and the concave bowl of the suction cup. For the purposes of this disclosure, the term "hard contact lenses" should also be taken to include semi-rigid, gas permeable lenses which are usually comprised of about 40% silafocon A and about 60% polymethylmethacrylate.

Regardless of whether the lenses are of the hard or the semi-rigid, gas permeable type, the problems associated with storing these lenses in soaking solutions by means of suction cups can be greatly reduced by modifying the configuration of the convex head of the molding pin used to form the concave bowl of the suction cup. Rather than having the diameter of the base of the convex head equal to the diameter of the cylindrical body so that there is a smooth contour between the head of the convex head and the outside surface of the body of the cylinder, the diameter of the convex head is purposely made smaller than the diameter of the cylinder. This, in effect, creates a ledge between the base of the convex head and the outside surface of the body of the cylinder. The existence of this ledge allows the plastic material to form a suction cup rim which when viewed in cross section, is relatively wide rather than pinched to a point. The wide ledge and the added "body" or volume of the ledge, vis-a-vis the pinched in rims found in the prior art, produces a lens contacting surface which, when viewed from the side, has a smooth edge rather than a jagged one.

Preferably, the width of the ledge, as seen by a side cross sectional view of the pin, will be from about 1 to about 20 percent of the diameter of the cylindrical body of the molding pin. Most preferably the width of the ledge will be from about 2 *to about* 10 *percent* of the cylinder diameter. The ledge, when viewed by holding the cylinder's long axis in a vertical plane, can deviate somewhat from a horizontal plane. A downward sloping ledge is however preferable to an upward sloping ledge since an upward sloping ledge tends to create a more narrow ledge surface which if carried to the extreme creates the same pinched rim problems encountered with the prior art suction cups. However, for reasons associated with the machining of the ledge on the end of the molding pin, as well as for reasons of getting good lens/ledge contact, a horizontal ledge is highly preferred. Likewise, for machining reasons, the convex head is preferably a dome which appears from its side cross sectional view to vary from a semicircle (i.e., the radius at the height of the dome is half the diameter of the dome at its base) to a truncated dome wherein the height of the dome is less than the base diameter of the dome.

DESCRIPTION OF THE DRAWINGS

A more complete understanding of the present invention may be had from the following detailed description of the preferred embodiments thereof particularly when read in the light of the accompanying drawings, wherein.

DESCRIPTION OF THE PREFERRED EMBODIMENTS

Figure 1:
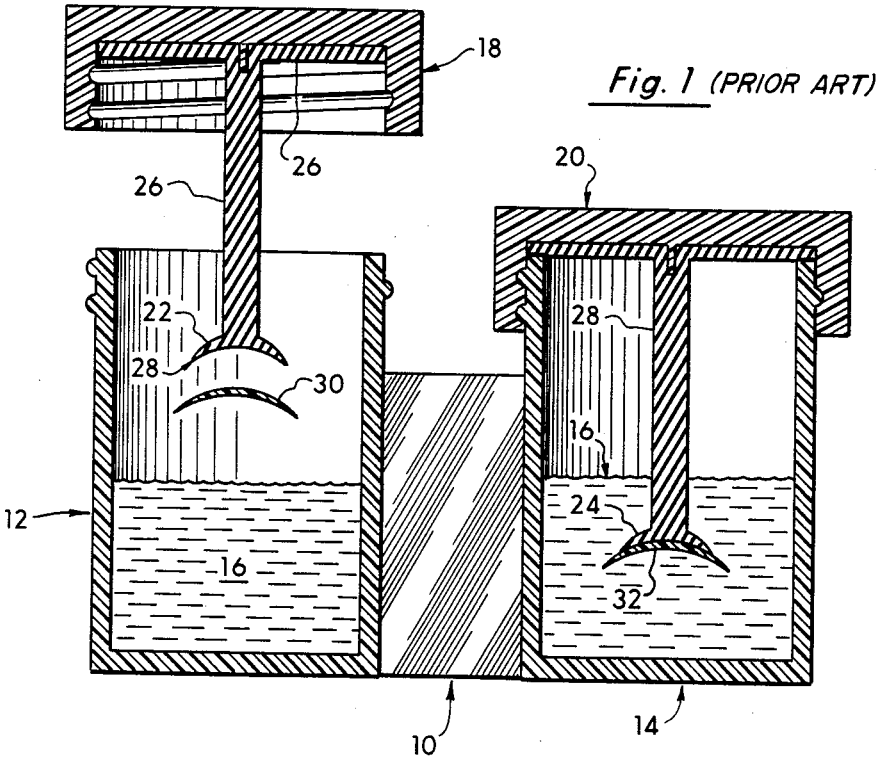
Fig. 1 (PRIOR ART)
FIG. 1 is a side view of the suction cups of this invention used to hold contact lenses in a soaking solution storage case having a left and a right compartment.

FIG. 1 shows a storage case 10 having a left compartment 12 and a right compartment 14 for storing a contact lens soaking solution 16. The left compartment 12 and the right compartment 14 are equipped with caps 18 and 20 respectively. Each cap is provided with a prior art suction cup 22 and 24 having stems 26 and 28 which are attached to their respective caps by means of a gasket ring 26 attached to the underside of the caps 18 and 20. The left suction cup 22 is shown with its rim 28 exposed and ready to receive the left contact lens 30. The right contact lens 32 is shown attached to suction cup 24 which is shown suspended in the contact soaking solution 16 in the right compartment 14 of the storage case 10.

Figure 2:
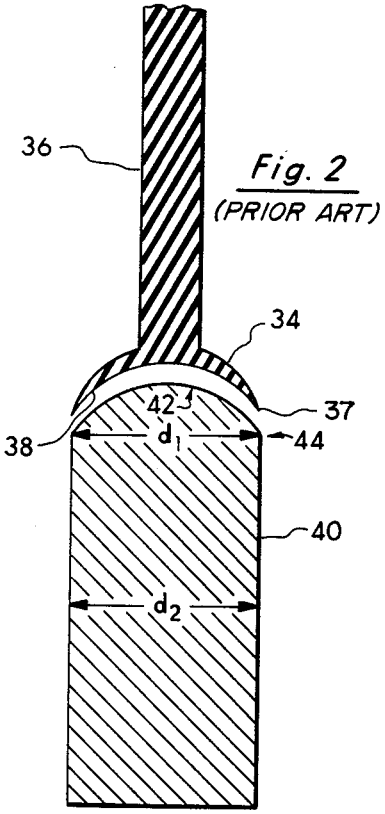
Fig. 2 (PRIOR ART)
FIG. 2 is a side view of a prior art suction cup and a cylindrical molding pin having a convex head used in molding the concave pod of a prior art suction cup.

FIG. 2 shows a side cross sectional view of a prior art suction cup 34 with its associated stem 36 made according to prior art molding techniques. The suction cup 34 has a rim 37 which comes to a point as indicated. The bowl 38 of the cup 34 is formed by cylindrical molding pin 40 having a convex head 42. In this cross sectional view, the diameter $d_1$ of the convex head 42 at its base 44 is exactly equal to the diameter $d_2$ of the cylindrical molding pin 40. The underside of the suction 34 and the stem 36 are formed by a second mold located in a molding chamber as shown in FIG. 3.

Figure 3:
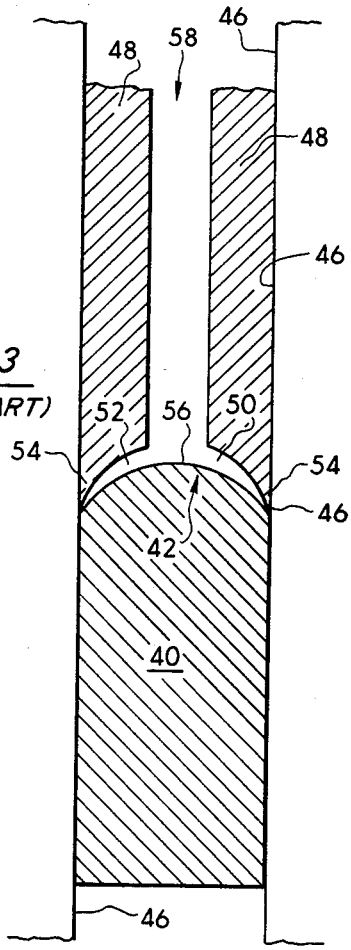
Fig. 3 (PRIOR ART)
FIG. 3 is a side view of the prior art molding pin projecting into a stemmed suction cup mold which forms the pod and stem of the suction cup.

FIG. 3 shows a cross sectional view of a molding system for making the prior art suction cup 34 of FIG. 2. The system is comprised of a tubular molding chamber 58, a mold 48 having a hollow core 50 in which the stem and pod of the suction cup of FIG. 2 are formed, and a cylindrical molding pin 40 shown with its convex head 42 extending into the pod portion 52 of the mold 48. The pointed portion of the suction cup rim is formed at the conjunction of the upper rim 54 of the mold 48, the upper surface 56 of the convex head 42 and the sides of the chamber 46. The plastic forming material from which the suction cup is made is injected into the core 50, plasticized, and then withdrawn from the mold 48 through the tubular molding chamber 58. Means for placing the mold 48 and the pin 40 in precise proximity to each other to regulate the thickness of the suction cup are not shown.

Figure 4:
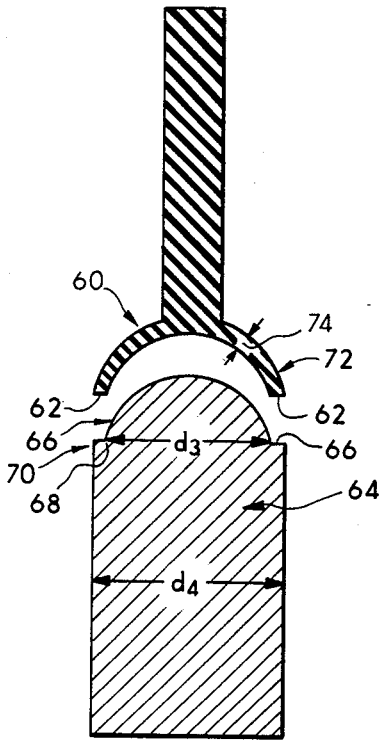
FIG. 4 is a side view of one embodiment of the suction cup and pin made according to the invention.

FIG. 4 shows a suction cup 60 made according to the teachings of this invention. The suction cup 60 is distinguished from the prior art suction cup 34 shown in FIG. 2 by the fact that suction cup 60 has a ledge 62 at its rim rather than the pointed cross section 37 shown in FIG. 2. This ledge 62 is produced by virtue of the fact that the molding pin 64 used to make it has a convex head 66 whose diameter $d_3$ at its base is less than the cross sectional diameter $d_4$ of the cylindrical molding pin 64. The differences in these two diameters results in a ledge 66 being formed between the base 68 of the convex head 66 and the outside surface 70 of the cylindrical pin 64. In this particular embodiment of the suction cup 60, the rim 62 formed by the ledge 66 of the molding pin 64 is about as wide as sides 72 of the pod portion of the suction cup are thick as indicated by dimension 74.

Figure 5:
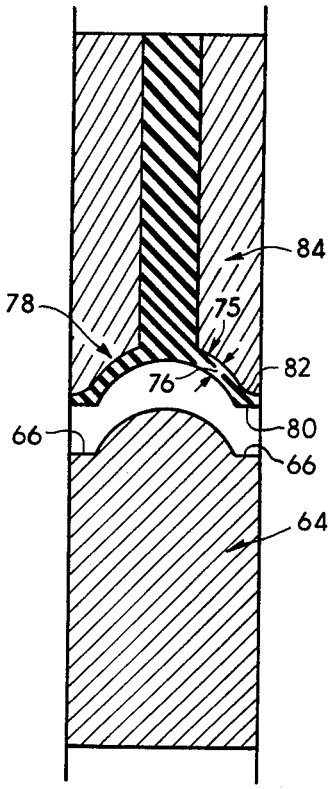
FIG. 5 is a side view of another preferred suction cup and molding pin.

FIG. 5 shows another version of a suction cup 78 of this invention wherein the rim ledge 80 formed between ledge 66 and the upper rim 82 of the second mold 84 is wider than the sides 75 of the pod portion of the suction cup as indicated by dimension 76.

Figure 6:
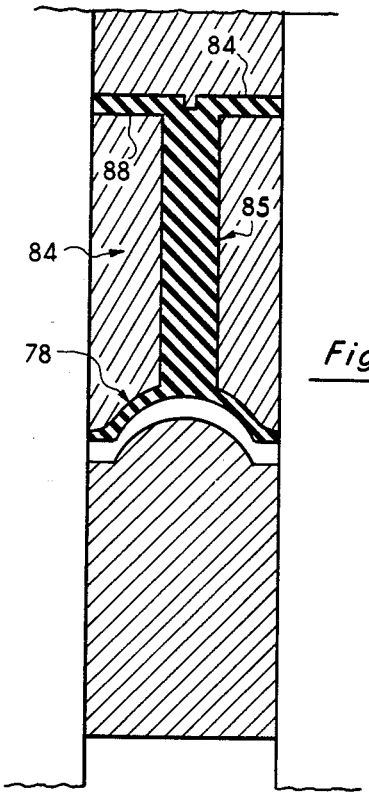
FIG. 6 is a side view of a suction cup wherein a base is attached to the stem of the suction cup to form a gasket ring for the cap of the storage case.

FIG. 6 shows another version of a suction cup of this invention wherein a gasket ring 84 as shown in the cap 18 of FIG. 1 is shown attached to the stem 86 of the suction cup 28. The mold 84 is provided with a hollow ring portion 88 for receiving and forming the plastic material such that the suction cup 78 including its stem 85 and the gasket ring 84 are molded as a single unit of elastomeric material.

Thus having disclosed my invention, I claim:

1. In a device for holding a hard contact lens in a soaking solution, said device comprising a stem terminating in a concave suction cup which being free of any air channel or vent, said cup terminating at a rim portion which comprises a substantially horizontal ledge, said ledge including a thickness which being at least as wide as the thickness of the wall of said cup, wherein the thickness of said ledge reinforcing said rim portion serves to prevent the solution from leaking into said cup.

2. In a device for holding a hard contact lens in a soaking solution, said device comprising a stem terminating into a concave suction cup which being free of any air channel or vent, said cup terminating at a rim portion which comprises a substantially horizontal ledge, said ledge including a thickness which being wider than the thickness of the wall of said cup, wherein the thickness of said ledge reinforcing said rim portion serves to prevent the solution from leaking into said cup.

3. In a device for holding a hard contact lens in a soaking solution, said device comprising a stem having a gasket at one end and a concave suction cup at other end, said cup being free of any air channel or vent, said cup terminating at a rim portion which comprises a substantially horizontal ledge, said ledge including a thickness which being at least as wide as the thickness of the wall of said cup wherein the thickness of said ledge reinforcing said rim portion serves to prevent the solution from leaking into said cup.

4. In a device for holding a hard contact lens in a soaking solution, said device comprising a stem having a gasket at one end and a concave suction cup at other end, said cup being free of any air channel or vent, said cup terminating at a rim portion which comprises a substantially horizontal ledge, said ledge including a thickness which being wider than the thickness of the wall of said cup, wherein the thickness of said ledge reinforcing said rim portion serves to prevent the solution from leaking into said cup.

* * * * *